US006164375A

United States Patent [19]

Carisella

[11] Patent Number: 6,164,375

[45] Date of Patent: Dec. 26, 2000

[54] APPARATUS AND METHOD FOR MANIPULATING AN AUXILIARY TOOL WITHIN A SUBTERRANEAN WELL

[76] Inventor: James V. Carisella, P.O. Box 10498, New Orleans, La. 70181-0498

[21] Appl. No.: 09/309,698

[22] Filed: May 11, 1999

[51] Int. Cl.[7] ..... E21B 23/04; E21B 23/08

[52] U.S. Cl. ..... 166/65.1; 166/373

[58] Field of Search ..... 166/63, 62.1, 373, 166/374, 381, 66.7, 76.1

[56] References Cited

U.S. PATENT DOCUMENTS

| | | | |
|---|---|---|---|
| 5,070,944 | 12/1991 | Hopper | 166/66.7 |
| 5,236,047 | 8/1993 | Pringle et al. | 166/369 |
| 5,353,877 | 10/1994 | Decorps et al. | 166/385 |
| 5,984,006 | 11/1999 | Read et al. | 166/63 |

*Primary Examiner*—Frank Tsay
*Attorney, Agent, or Firm*—Beirne Maynard & Parsons LLP

[57] ABSTRACT

An auxiliary tool within a subterranean well may be manipulated, such as set, by the apparatus having a stroking rod which is manipulated by application of well pressure through fluids in the well combined with booster pressure explosively generated within the apparatus.

30 Claims, 9 Drawing Sheets

APPARATUS AND METHOD FOR MANIPULATING AN AUXILIARY TOOL WITHIN A SUBTERRANEAN WELL

BACKGROUND OF THE INVENTION (1) Field of the Invention

The invention relates to an apparatus for manipulation of an auxiliary tool within a subterranean well.

(2) Brief Description of the Prior Art

The art is well aware of various types of tools or devices which must be operated, such as set, retrieved, activated, or the like, at a given depth or location within a subterranean well. Such devices include expandable elastomeric permanent or retrievable plugs, packers, ball-type and other valves, injectors, perforating guns, tubing and casing hangers, cement plug dropping heads, and other devices typically encountered during the drilling, completion and/or workover of a subterranean well. Such devices and tools will hereafter collectively be referred to as "auxiliary tools."

Activation or manipulation of some of such auxiliary tools often is achieved by use of some sort of apparatus, sometimes referred to as a "setting tool," which may be introduced into the well along with or subsequent to the auxiliary tool on wire or electric line, continuous or coiled tubing, or by other known means. Some of such setting or manipulation tools are known to apply hydrostatic well pressure within well fluids at the setting or activating depth through the setting apparatus and upon a face of a piston head or the like to move a stroking rod, cylinder or housing member in a direction to activate manipulation of the setting tool. Likewise, such manipulation or setting tools are also available which are activated by means of a power charge to cause an explosion within a portion of the housing of the manipulation tool and the energy defined by this explosion drives such piston, stroking rod, or other member to cause the manipulation of the auxiliary tool. By "explosion" is meant the continuous generation, sometimes comparatively slowly, of energy by electric activation of a power charge-initiated reaction which results in a build up within a chamber of transmittable gaseous pressure within the apparatus.

Some types of auxiliary tools cannot be completely manipulated, such as set, simply by incorporation into the manipulation tool of either energy defined through a conventional power charge-initiated explosion within the device or simply by the use of hydrostatic pressure defined in and through well fluids at the manipulation or setting depth in the well.

The present invention addresses the deficiencies found in the prior art by providing an apparatus and method which sequentially apply to a stroking rod assembly within the manipulating apparatus the forces generated by both hydrostatic pressure of the well fluids at the setting or manipulation depth within the well and the force generated by energy defined through a controlled explosion generated within the manipulation apparatus.

SUMMARY OF THE INVENTION

The invention includes an apparatus and method for manipulating an auxiliary tool within a subterranean well. The apparatus comprises means for selective transmission within the apparatus of a primary source of pressure of and defined within one of: (a) well fluids in the well; and (b) pressure generated by controlled explosion within the apparatus. Means are provided for transmitting within the apparatus a secondary source of pressure generated by the other of the well fluids and the pressure generated as a result of the controlled explosion within the apparatus. Means also are provided which are responsive to the primary source of pressure within the apparatus to manipulate the auxiliary tool a first amount and thereafter further responsive to pressure generated by the secondary source of pressure in excess of the primary source to manipulate the auxiliary tool a second amount.

In a preferred embodiment, the primary source of pressure are the well fluids and the hydrostatic pressure thereof at the manipulation or setting depth in the well acting upon one face of the piston head member of a stroking rod assembly having an opposing face exposed to a one-atmosphere chamber. In such instance, the secondary source of pressure is energy which is generated by a controlled explosion within the apparatus.

One or more of the means for selective transmission of the primary source of pressure and the secondary source of pressure are actuated by electric voltage signal. Such signal may be through a conventional electric line transmitted to a diode package which separates the signal to selectively actuate such elements.

In a preferred embodiment, a unique filtering system is provided for a multi-faze separation of particulates and other contaminants from the well fluids prior to entry into a chamber for actuation upon one of the faces of the piston head. Preferably, the filtering system will include sized passageways through the housing of the apparatus, downstream of which is provided a series of separately, finely meshed filter screens traversing the flow path of the well fluids into the apparatus and, subsequently, further downstream, the provision of a filter cloth or fiber sock assembly for final segregation of such matter from the final clean fluid which is delivered to a chamber for actuation upon one face of the piston head.

In an embodiment, the invention also provides a metering mechanism and one way check valve assembly for assuring a smooth, selectively timed stroking of the rod assembly and, thereafter, concurrently with actuation upon a stroking rod of the secondary source of pressure, a one-way check valve assembly which is slammed closed to block the discharge of fluids within the control chamber immediate the piston head of the stroking rod such that maximum pressure defined through the primary source of pressure acting on the piston head is trapped in the control chamber for continued actuation upon the piston head.

The invention also incorporates in one embodiment a valving means which is responsive to electric voltage to selectively communicate hydrostatic well pressure within the well and exterior of the apparatus across one of the piston head faces to move a control mandrel in one direction from an initial position to a first position for manipulation of the auxiliary tool. The valving system comprises an electronically activated detonator which is carried within a tubular housing having a "V" or similarly configured slit which permits the cylindrical housing to shatter, part, or separate as the breaching tube is heated or ignited by electronic detonation, to permit the entry and communication of well fluids within the housing and into the control chamber for activation of the setting rod and upon one face of the piston head associated with such setting rod.

In operation, the apparatus is run into the well upon a conduit, such as wireline, electric line, tubing or the like, preferably in combination with the auxiliary tool. However, it will be appreciated by those skilled in the art that there may be application for use of manipulation tool of the present invention when the auxiliary tool has been previously run into the well. In any event, upon reaching a pre-selected depth in the well for manipulation of the auxiliary tool, the primary source of pressure is transmitted within the apparatus such as by transmitting an electric voltage charge to the detonator to shatter or separate the housing therefor and open such valving means for communication of hydrostatic well fluid pressure through the apparatus and into a chamber for application upon a stroking rod, or the like, to manipulate the auxiliary tool a first amount. Thereafter, after waiting a pre-selected, reasonably calculable amount of time, a second electric signal is transmitted to the device to, for example, actuate an explosion in a booster pressure assembly within the apparatus, to deliver a second source of pressure through the apparatus and upon the piston head or the like to continue the stroking of the rod or other member.

It will be appreciated that the preferred means for transmitting electric voltage signal herein is through electric line of known type and commercially available which extends from the top of the well to a connector within the apparatus. However, it is contemplated that the electric voltage signal may be generated by means other than the conventional electric line extending from the top of the well to the apparatus, such as by radio frequency signal transmitted to a battery or otherwise similarly actuated assembly within the device which, in turn, transmits the electric voltage signal internally and within the apparatus. The electric voltage signal may also be initiated or transmitted through contact with a casing or other member exposed exterior of the apparatus by electric contact means positioned between the apparatus and the well casing or other conduit member extending to the top of the well. Likewise, it is contemplated that the electric voltage signal may also be generated as a result of receipt of power pulsation signals generated through the drilling, completion or workover fluid column in the well exterior of the apparatus similar to signals incorporated within measurement while drilling ("MWD") apparatuses. Methods of manipulating an auxiliary tool by use of an apparatus of the present invention are also disclosed and claimed. The invention also includes a device for retrieval of the apparatus, as well as a set and release mechanism.

DESCRIPTION OF THE PREFERRED EMBODIMENTS

Figure 1A:
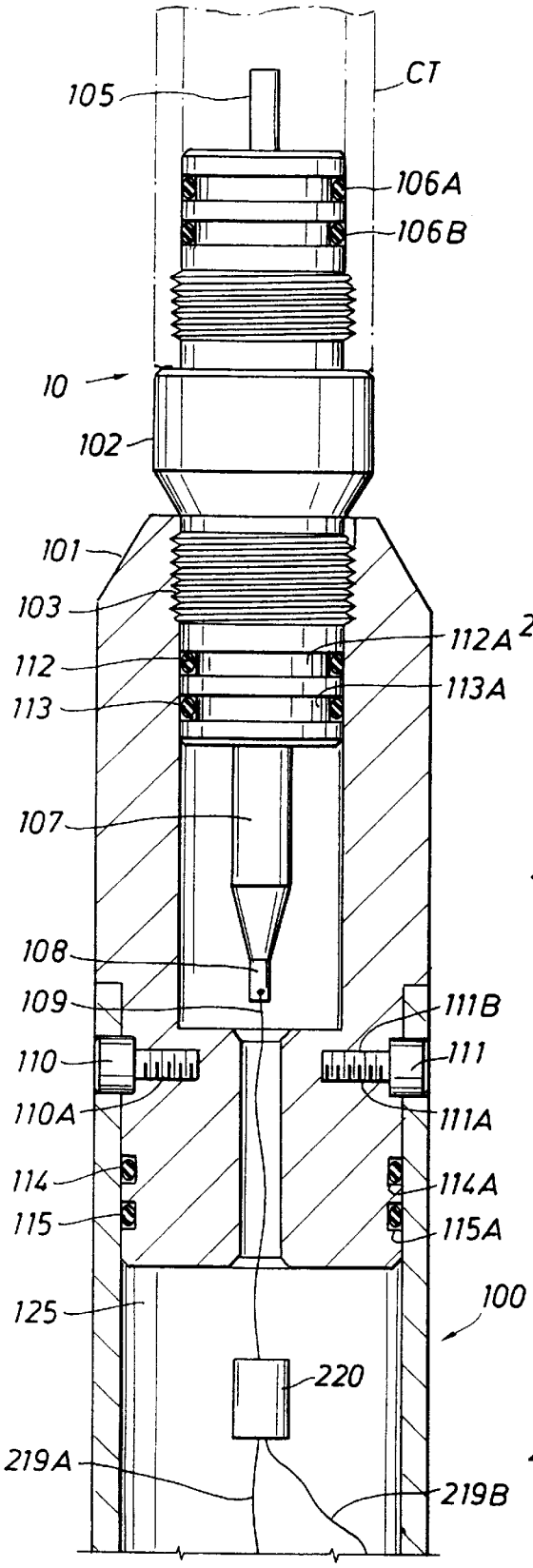
FIGS. 1A, 1B, 1C, 1D, 1E and 1F together constitute a longitudinally extending partial cross-sectional view of the apparatus of the present invention in the run-in position and prior to activation.

Now, with first reference to FIGS. 1A–1F, there is shown the apparatus 10 generally consisting of an outer cylindrical housing 100 within which is contained a control mandrel 200 associated at its uppermost end with a booster charge assembly 208 and, therebelow, the means for selective transmission of a primary source of power 300. Immediately below the power source 300 and carried within the cylindrical housing 100 and around the control mandrel 200 is a screen filter assembly 400. Downstream of the screen filter assembly 400 is the fluid metering and pressure locking assembly 500. A set and release mechanism 700 (FIG. 1F) is shown disposed lowerly of the cylindrical housing 100 and around the exterior of the control mandrel 200.

Now with specific reference to FIG. 1A, the cylindrical housing 100 is defined at its uppermost end by a top sub member 101 which is secured to an electrical connector 102 at threads 103. Similarly profiled threads 104 are disposed at the upper most end of the electrical connector 102 for attachment to the lowermost end of coiled tubing CT or other tubular member, if it is desired to introduce the apparatus 10 into the well on such tubular conduit. The elastomeric o-ring seal elements 106A and 106B are provided in grooveways above the threads 104 on the electrical connector 102 to prevent fluid transmission between the coiled tubing CT and the electrical connector 102. The lower end of an electric conduit 105 extends upwardly and outwardly of the electrical connector 102 and extends to the top (not shown) of the well, in normal fashion. The electrical connector 102 extends inwardly of the top sub outer housing member 101 to a downwardly protruding tear drop electrical connector 107 upon which at securement 108 a multi-stranded insulated wire 109 extends inwardly and through a passage 101A to a diode mechanism 220, discussed in detail below.

The top sub member 101 includes a vertically extending bore 110D with threads 110A for threaded receipt of a securing pin 110 to secure the top sub member 101 to a lowerly extending atmospheric chamber housing member 116. A similar pin configuration 111 is shown offset 180° from the pin 110 and extending within bore 111B for threaded mating engagement with companion threads 111A, for like purpose as pin 110. Companion o-ring elements 112 and 113 are circumferentially provided within grooveways 112A and 113A, respectively, around the lowermost exterior end of the electrical connector 102 to prevent fluid and pressure transmission between the electrical connector 102 and the top sub member 101. Likewise, the elastomeric o-ring seal elements 112 and 113 define the uppermost end of an atmospheric chamber 125 defined within the top sub 101 and the atmospheric chamber housing 116. The lowermost end of such atmospheric chamber 125 is defined as the upper face of a piston head 202, such face being defined across the piston head 202 by means of elastomeric swabbing seal 204 placed within the uppermost portion of the piston head 202 within circumferentially subscribed bore 204B to define the upper, or second, piston face 206.

Fluid communication between the lowermost end of the top sub member 101 and the atmospheric chamber member 116 is prevented by provision of elastomeric o-ring seal elements 114 and 115 carried within their respective exteriorally defined grooveways 114A and 115A on the top sub member 101.

The cylindrical housing 100 extends lowerly of the atmospheric chamber housing member 116 by means of a housing connector 118 which is threadedly secured by threads 117 to the lowermost end of the atmospheric chamber housing member 116. Likewise, the lower end of the connector 118 is secured at threads 119 to the upper end of a cylindrical meter and check valve housing member 120. Threads 121 at the lowermost end of the meter and check valve housing member 120 secure a companion primary power source housing member 301 thereto.

Finally, the outer cylindrical housing 100 terminates at its lowermost end by means of a bottom sub member 124 having an open passage 124B therein, with smooth outer wall 124 extending therearound. Threads 123 secure the bottom sub 124 to the lowermost end of the primary power source housing member 301.

Now referring to FIG. 1E, the primary power source housing member 301 of the outer housing 100 includes a series 122 of sized fluid passages 122A, 122B and 122C which are diametrically sized to act as a first or coarse filter of particulate contaminants within the well fluids exterior of the apparatus which, as discussed below, will be permitted to enter the interior of the apparatus 10, during operation.

Figure 1B:
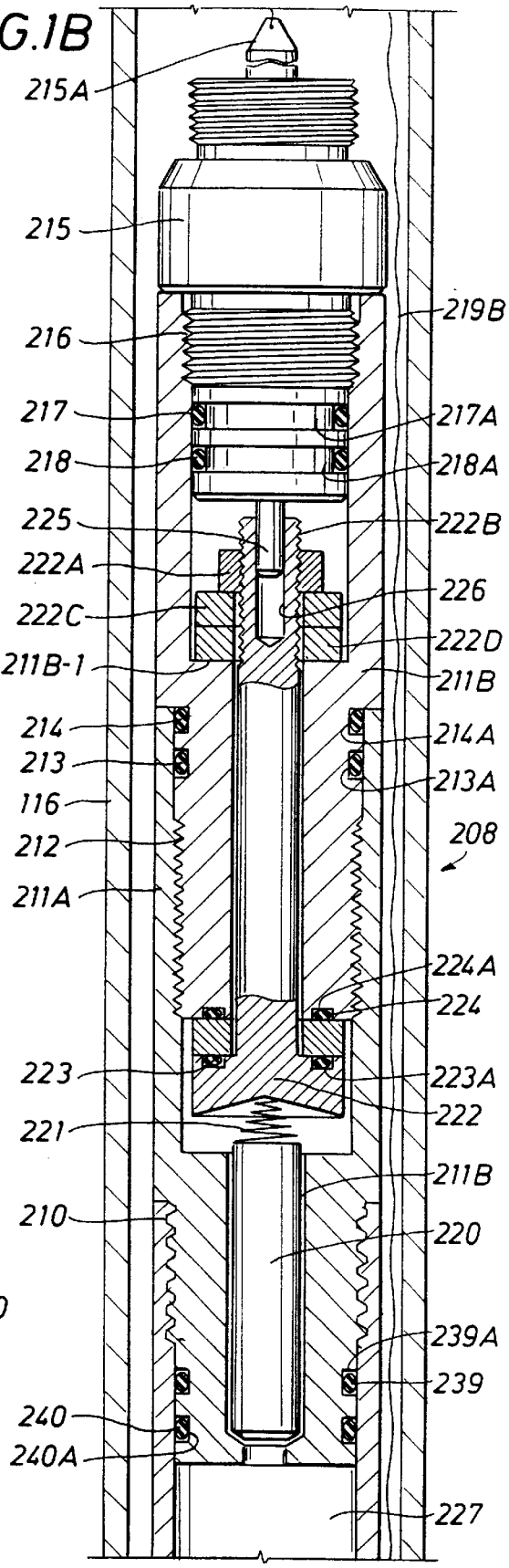
Figure 1C:
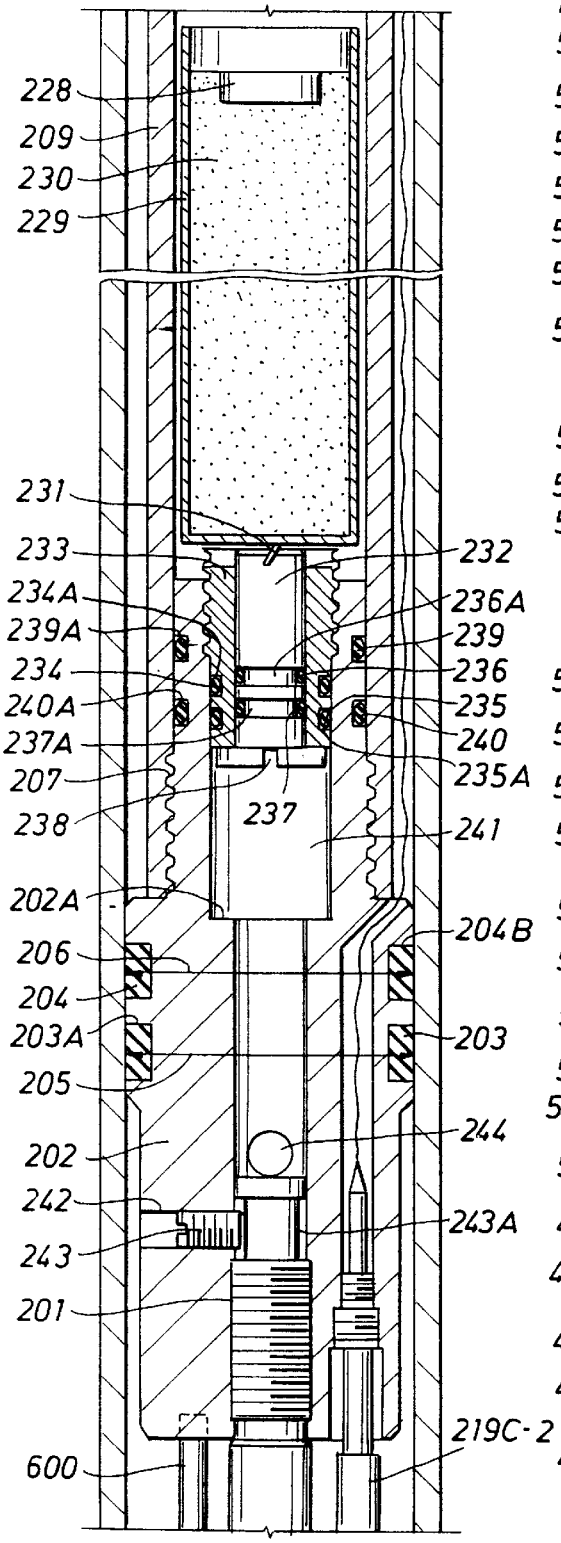

Component parts of the apparatus 10 within the atmospheric chamber housing member 116, including the booster charge assembly 208, will now be described. As shown in FIG. 1B, electric line 219A extends from control diode 220 and is secured to an upperwardly facing tip 215A within electric connector 215 secured at threads 216 to an upper primary ignition housing member 211B having one end protruding into the upper most end of a companion lower primary ignition housing member 211A. The members 211A, 211B are secured to one another at threads 212. Fluid transmission is prevented thereacross by primary and secondary elastomeric o-ring seal elements 213 and 214, respectively, carried within companion circular grooveways 213A and 214A, exteriorally defined on the upper primary ignition housing member 211. Likewise, the primary and secondary rings 217 and 218 carried in companion grooveways 217A and 218A are defined exteriorally around the connector 215 to prevent fluid transmission between the exterior of the connector 215 and the interior of the upper primary ignition housing member 211B.

An electrically actuated short control hammer member 225 protrudes outwardly and downwardly from the lowermost end of the connector 215 within bore 226 of an ignitor charge housing 222, of known construction, which is activated by application of the control hammer 225, discussed below. Locking nut 222A is threaded at 222B to the exterior of the charge housing 222 with washers 222C and 222D sandwiched between the nut 222A and a companion shoulder 211B-1 facing upwardly on the upper primary ignition housing member 211B. A similar washer assembly 222E is sandwiched between the charge housing 222 and upon a downwardly facing shoulder 211B-2 at the lowermost end of the charge 222 for additional securement. O-ring elements 223 and 224 are positioned above and below the ring 222E to prevent fluid communication between the charge housing 222 and the upper primary ignition housing member 211B, with the rings 223 and 224 carried exteriorally within circular grooveways 223A and 224A, respectively.

A coil 221, again of known and commercial construction, extends from the lowermost end of the charge housing 222 to an explosion initiator 220 carried interiorally within a receptacle portion 211B of the lower primary ignition housing member 211A. Threads 210 are provided between the lowermost outer end of the lower primary ignition housing 211A and a cylindrical lower booster pressure chamber housing member 209, with o-ring seal elements 239 and 240 carried in companion grooveways 239A and 240A on the lower primary ignition housing member 211A preventing fluid communication between the members 211A and 209.

The seals 239 and 240 define the uppermost end of a booster pressure chamber 227 contained within the housing member 209, with companion seals 234 and 235 within grooveways 234A and 235A on the uppermost end of the swabbing piston head 202 defining the lower most end of the booster pressure chamber 227.

A power charge 230, which is of known composition and operation to those skilled in the art of power charge activation of subterranean tools, is carried within a power charge housing member 229 secured by means of a shearable pin member 231 to a piston housing 232 there below. A secondary ignitor 228 is provided within the power charge housing 229 for ignition of the power charge 230, as described below, when the explosion initiator 220 is activated.

The piston housing 233 is secured at threads 233A to the uppermost interior end of the swabbing piston head 202, with a booster piston 232 being secured to the power charge housing 229 by means of the shear pin 231. In the initial run-in position, and prior to actuation of the apparatus 10, the booster piston 232 is secured in place relative to the housing 229 with o-ring seal elements 236 and 237 within respective groove members 236A and 237A being disposed around the exterior of the piston member 232 and within the piston housing 233 to prevent fluid communication there between. The booster piston 232 lowermost end is defined as an enlarged head member 232A across which is traversed a booster power passage 238.

Finally, the exterior of the piston housing 233 carries within groveways 234A and 235A similar o-ring seal elements 234 and 235 to prevent fluid communication between the piston housing 233 and the swabbing piston head 202.

The swabbing piston head 202 defines a booster cavity 241 therein which, when the booster 232 is released from the power charge housing 229 by appropriate action upon the shear pin 231, receives the separated booster piston 232, and the head 232A comes to rest upon and upwardly facing shoulder 202A on the swabbing piston head 202. Pressure defined by the energy stored within the booster pressure chamber 227 as a result of activation of the power charge 230 to indicate the controlled and timed explosion is permitted to be transmitted from the booster pressure chamber 227 through the booster power passage 238 downwardly and around the exterior of the swabbing piston head 202 to act upon the first piston head face 205 defined at the seal 203 on the swabbing piston head 202 to drive the swabbing piston head 202 and the control mandrel 200 upwardly from the first manipulating position to the second, or final, manipulating position, as described below.

A solid release stud 244 secures the swabbing piston head 202 to the uppermost end of the control mandrel 200 to prevent premature activation as the apparatus 10 is introduced into the well and moved to the manipulation position. Tension applied between the cylindrical housing 100 and the upwardly moving head 202 upon the control mandrel 200 in excess of a predetermined amount during application of hydrostatic well fluid to the apparatus 10 during initial manipulation will cause the release stud 244 to become separated to permit continued movement of the control mandrel 200, upwardly.

The control mandrel 200 is secured to the swabbing piston head 202 by threads 201, with additional securement being provided by set screw 243 being emplaced within bore 242 of the piston head 202 and upon a side wall 243A of the control mandrel 200.

Figure 1D:
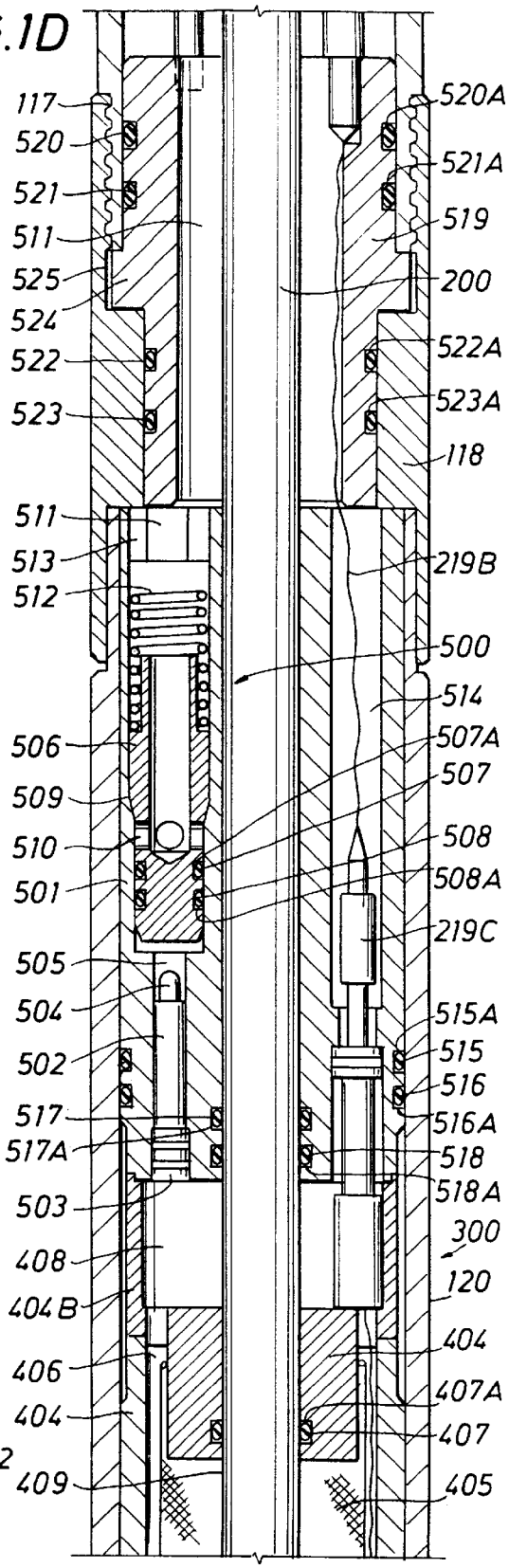
Figure 1E:
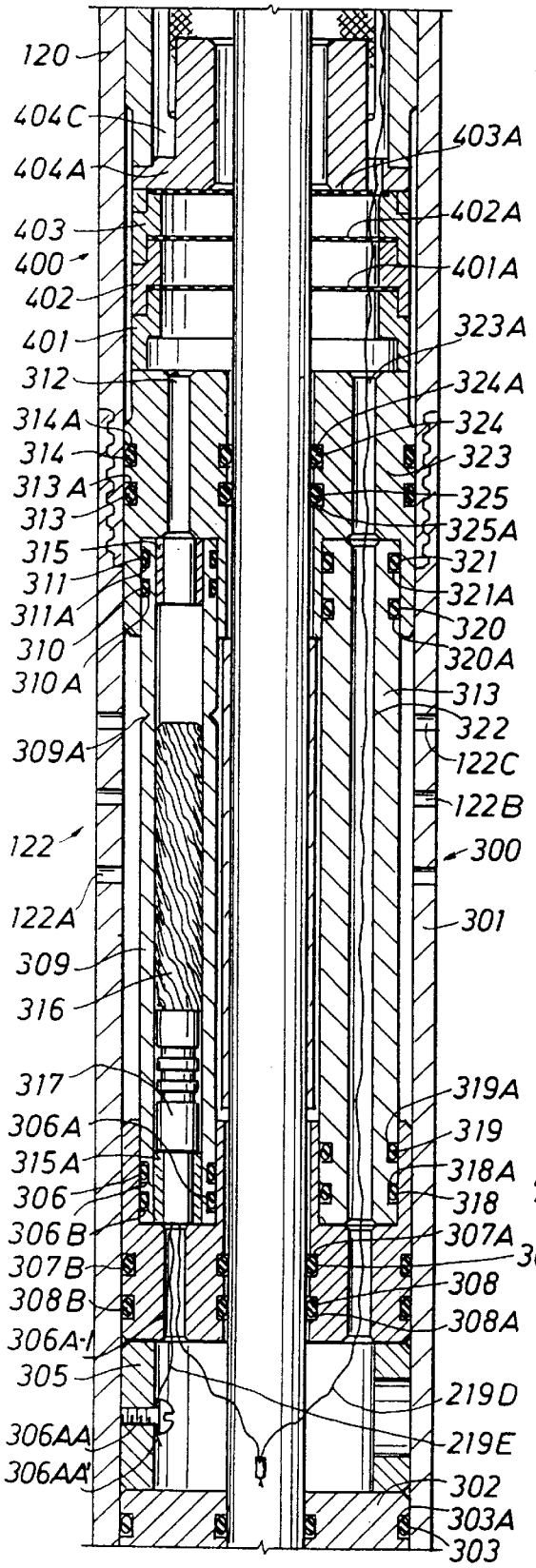

The means for selective transmission of a primary source of power 300 is shown in FIGS. 1D and 1E and will now be discussed. Within the primary power source housing member 301 is a ground connection isolator 302. A connector 306 within bore 306A-1 securer a ground line element 219E extending to a lower breaching tube receptacle 306 protruding out of a detonator support 317 which causes activation, in conventional fashion, of a detonator charge 316 disposed within a longitudinally extending cylindrical breachable tube member 309.

An electric conduit line member 219D also extends from the detonator support 317 and carries an electric voltage signal therethrough to the power source 300, with the line 219D extending within a passage 322 of an electric conduit housing member 317 in a pocket provided between the lower bridgeable tube receptacle 306 and a companion upper breachable tubing receptacle 323. The electric conduit line member 219D is affixed to the lowermost end of a separable connector 219C having separating members initially interengaged at 219C-1. The electric voltage charge to the primary power source 300 is carried to the connector 219C through line member 219B to a ceramic bulk head electrical feed connection 219-C-2 and continues downwardly thereto from the diode 220 through line member 219B.

A series of seals 303 and 304 carried within respective grooveways 303A and 304B in the ground connection isolator 302 prevent well fluids passing interiorly through the primary source housing member 301 from being to be transmitted therebelow.

The ground block housing 305 containing the connector 306 is sandwiched between the ground connection isolator 302 and the lowermost face of the lower breachable tube receptacle 306. Screw 306AA' in bore 306AA in the block 305 secures the ground line 219D to the block housing 305. Seals 307 and 308 are contained within a grooveway, respectively, 307A and 308A, and dynamically seal between the inner most side of the lower breachable tube receptacle 306 and the stroking control rod or mandrel 200. Likewise, seals 307B and 308B are contained within their respective grooveways 307B-1 and 308B-1 to prevent fluid communication between the outermost wall of the lower breachable tube receptacle 306 in the interior wall of the primary power source housing member 301.

The breachable tube 309 is snugly positioned between the lower and upper breachable tube receptacles 306 and 323 with seals 306A and 306B providing sealing integrity between the tube 309 and the receptacle 306. Likewise, upper and lower seals 311 and 310 disposed within grooveways 311A and 310A, prevent fluid transmission between the tube 309 and the upper breachable tube receptacle 323. A support member 315 is expansively provided within the upper most end of the breachable tube 309 to assure proper securement relative to the receptacle 323. A similarly configured expansion support 315A is carried lowerly within the breachable tube 309 for like purpose.

The breachable tube 309 may be made of light metal, glass, or the like, and may either be shatterable as a result of explosive force or, preferably, is provided with a "V" or other geometrically configured slit 309A which is intended to permit the tube 309A to shatter or part at the slit 309A to thereby define the opening 309A-1 (FIG. 20) upon detonation of the detonator 316 to permit well fluids to pass through the passageways 122A, 122B and 122C into the interior or passageway 312 defined through the tube 309 and the upper breachable tube receptacle 323, thence across screen filter assembly 400, as described, below.

Seals 313 and 314 are provided in grooveways 313A and 314A around the exterior of the upper breachable tube receptacle 323 to prevent fluid communication between that member and the meter and check valve housing member 120, thereabove.

Offset 180 degrees from the breachable tube 309 and also sandwiched in between the upper and lower receptacles 306 and 323 is the electric conduit housing member 317 which receives within passage 322 the electric conduit line member 219D, the line 219D extending upwardly through a passageway member 323A offset 180 degrees from the passageway 312 within the upper breachable tube receptacle 323.

Seals 320 and 321 carried within grooveways 320A and 321A are provided around the exterior of the upper most end of the electric conduit housing member 317 to prevent fluid transmission thereacross relative to the upper breaching tube receptacle 323. Finally, seals 324 and 325 are carried within grooveways 324A and 325A around the interior of the upper receptacle 323 and statically contact the smooth outer wall of the control mandrel 200 as the control mandrel 200 is manipulated.

Figure 2A:
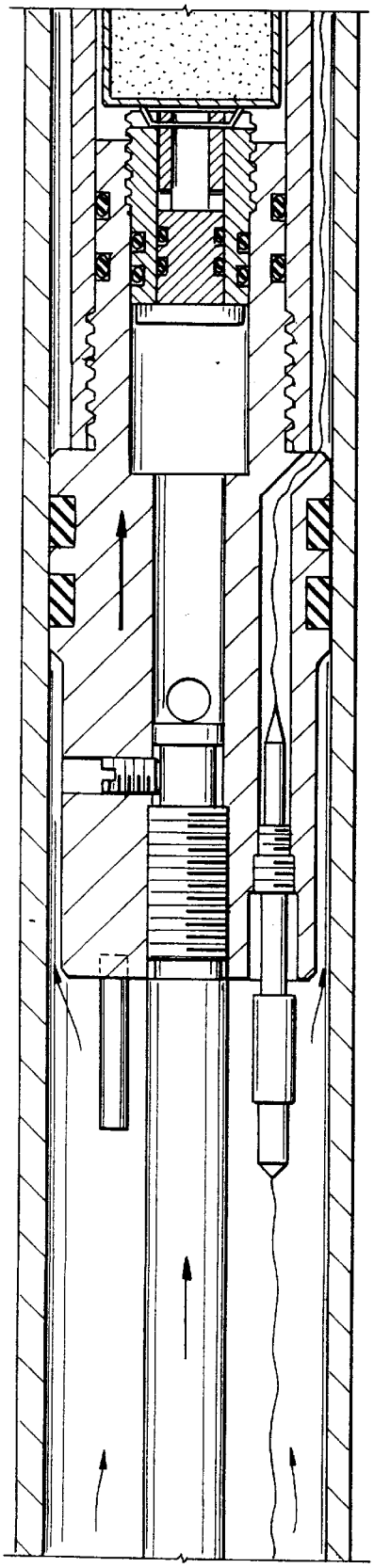
FIGS. 2A, 2B, 2C, and 2D together constitute a longitudinal partial cross-sectional view of the apparatus of the present invention subsequent to activation of the device to permit hydrostatic pressure within well fluids to manipulate the stroking rod a first amount, with arrows indicating the location and direction of fluid flow of such well fluids within said apparatus and the direction of stroke of the stroking rod.
Figure 2B:
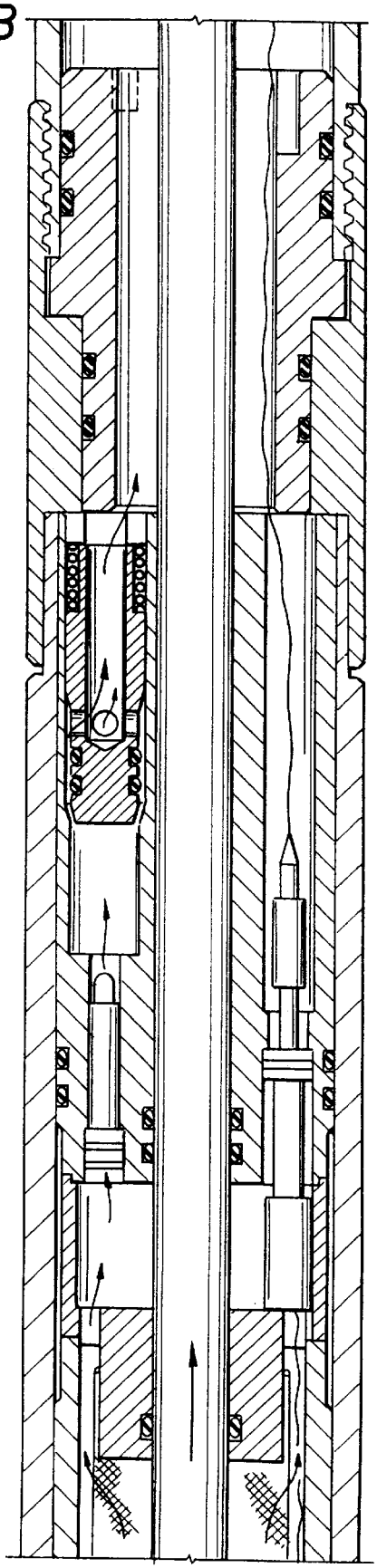
Figure 2C:
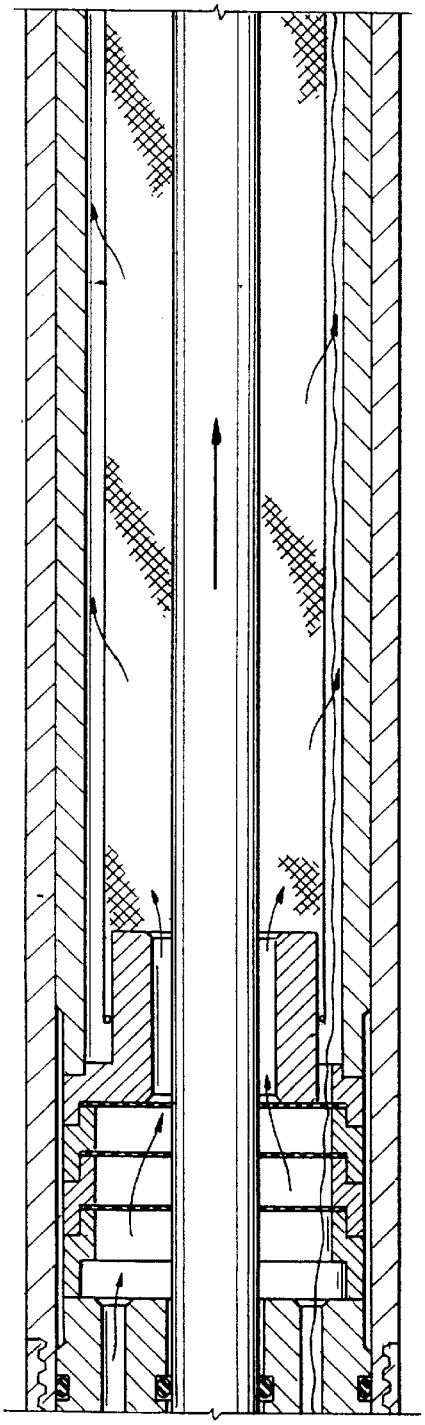
Figure 2D:
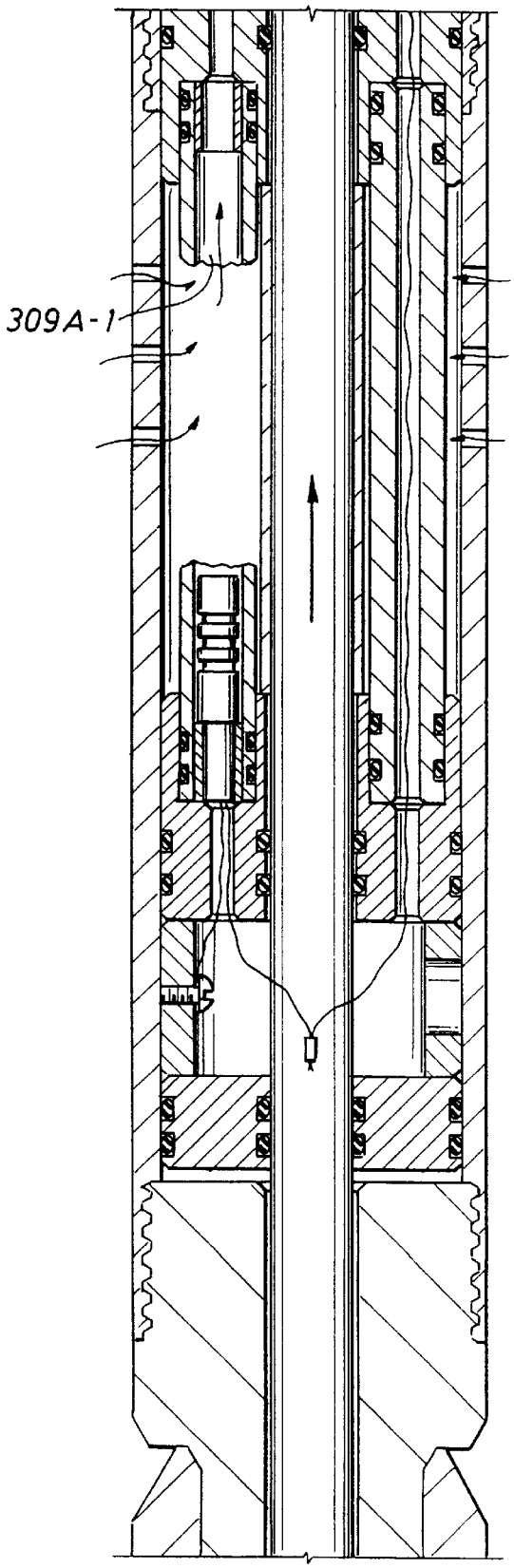

Subsequent to detonation of the detonator 316 and the breaching at the "V" slit 309A, as discussed earlier, well fluids will be filtered through the passageways 122A, 122B and 120C and will pass inwardly through the interior of the tube 309 through the opening 309A-1 and will be transmitted through the passageway 312 for additional secondary filtration of solid particulate or contaminants by means of the screen filter assembly 400. As shown in FIG. 1E, the assembly 400 consists of a series of stacked housing elements 401, 402 and 403 securing thereacross separately sized metallic screen members 401A, 402A, and 403A, of varying and sequentially finer mesh openings. One or more of such screens and housings may be placed within the apparatus 10 as necessary. The housings 401, 402, and 403 are held in place, one to another, between the uppermost end of the upper breaching tube receptacle 323 and the lower end of a lower filter sock housing member 404A. The direction of flow of filtered well fluids through the screen filter assembly 400 is shown in FIG. 2E by arrows.

Downstream of the screen filter assembly 400 is another, or tertiary, and even finer, filtering system which incorporates a filter sock concept. This additional filtering of the well fluids assures maximum clean fluid for passage through the intricacies of the meter assembly 502 and the companion check valve assembly downstream thereof, to avoid undesirable valve "shatter" or clogging of flow passages, as described, since dependable and accurate metering of the well fluids may be extremely important in determining sequencing activation of the booster charge assembly 208.

A fabric cloth "sock" 405, commercially available and made of fine cotton or synthetic fiber weave is placed around upper and lower sock housing sleeves 404 and 404-A, respectively. Seal 407 is carried within grooveway 407A around the interior of the upper housing member 404 for dynamic sealing with the outer smooth surface of the control mandrel 200 as it is manipulated.

Unlike the upper housing member 404, the lower member 404-A has a longitudinally extend flow passageway 404C in the middle thereof and around the control mandrel 200 to permit clean fluid to enter into the sock interior 409 for additional cleaning and separation through the openings between the weave of the sock 405. A clean fluid chamber 408 extends between the filter sock 405 and a filter sock housing member 404D which is secured in place through expander 404B contacting the lowermost end of the meter housing 501 thereabove.

As the finely cleaned well fluid is transmitted through the clean fluid chamber 408, the fluid will pass through an opening 503 in a metering assembly 502 having an office at its uppermost end, or downstream, of the opening 503, for controlling the rate flow of fluid downstream of the assembly 502 and within the meter housing 501 receiving the assembly 502. The uppermost end of the meter housing 501 is profiled to receive a check valve housing 506 which is biased downwardly, or towards the upstream side, by the compressive force defined through a spring 512 having its uppermost end normally positioned against a retainer 513 within the meter housing 501. The lowermost or downstream end of the check valve housing 506 is defined exteriorly therearound first and second elastomeric o-ring seal elements 507 and 508 within grooveways 507A and 508A to prevent fluid communication between the check valve housing 506 and the meter housing 501.

In the initial, or run-in-position, and prior to activation of the apparatus 10, the check valve is as shown in position in FIG. 1D with the spring 512 acting upon the housing 506 to drive the housing 506 into a valve seat area 509A extending upstream—wise by defined shoulder 509 to a central chamber 511 having passage 510 for transmission of fluid, as described. As fluid is metered through the orifice 504, the compressive force defined through the spring 512 will be increased and the check valve housing 506 will move upstream, relative to the meter housing 501, so that the seal members 507 and 508 come out of contact engagement with the surface 509A in the meter housing 501 to permit fluid to pass through passage 510 and the end of the central chamber 511 for continued transmission through passageway 519A defined within the housing retainer 519 thereabove.

The housing retainer 519 contains seal members 523 and 522 within respective grooveways 523A and 522A in the retainer 519 to prevent fluid communication between the member 519 and the housing connector 118. Likewise, seals 521 and 520 are provided within grooveways 521A and 520A within the upper most end of the retainer 519 to prevent fluid communication between the retainer 519 and the atmospheric chamber housing member 116.

Fluid passing through the fluid metering and pressure locking assembly 500 is transmitted through the central chamber 511, the passageway 519A for application across face 205 of the swabbing piston head 202.

Subsequent to activation of the booster charge assembly 208, pressure within the central chamber 511 and its companion passageways below, or downstream, of the first or lower piston head face 205 will be increased, substantially, over the hydrostatic pressure of the well fluids transmitted through the fluid metering and pressure locking assembly 500. The compressive bias through the spring 512 will be overcome and the check valve housing 506 will be driven downstream, such that the seal elements 507 and 508 will return to the smaller smooth bore seat area 509A above the shoulder 509 to thereby lock fluid pressure within the control chamber 511 and upon the lower or first piston head face 205, so that such pressure may act in combination with the energy defined through the booster charge assembly 208 activation to further drive the piston head 202 and connected control mandrel 200 upwardly from the first manipulation positioned to the final manipulation position for the auxiliary tool.

Figure 1F:
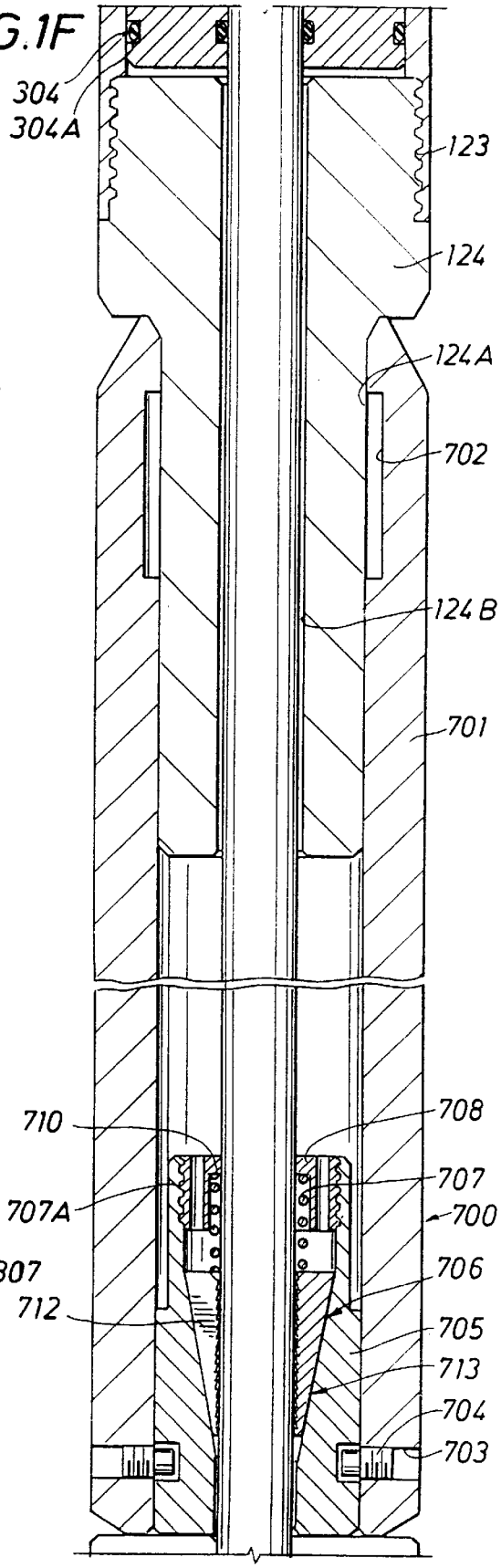

The component parts of the set and release mechanism 700 will now be discussed and are shown in the initial position in FIG. 1F. The set and release mechanism 700 is disposed lowerly of the bottom sub 124 and is secured thereto by means of a cylindrical longitudinally extending outer housing member 701 being placed around a bottom sub protrusion portion 124A.

The outer housing member 701 is shear releasable relative to the protrusion portion 124A by means of insertion of a shear pin 704 within a bore 703 extending within the housing member 701 and the bottom protrusion portion 124A. The outer housing 701 includes an inner circularly defined pulling profile 702 which is engaged to a pulling tool when it is desired to release, deactivate, or pull the auxiliary tool to another location within the well, or retrieve same to the top of the well. The innermost end of the shear pin 704 extends within the bore portion 703 defined within a cone housing 705. The cone housing 705 has a "V"-shaped ramp 706 which has an enlarged interior diameter within its uppermost end, as compared to a smaller, internal diameter as the ramp 706 tappers downwardly. The cone housing 705 is made up of a number of radial sections (See FIG. 4) which, in the position of the setting tool prior to release, are in side-by-side circular orientation, but break apart during the release operation discussed below.

Figure 4:
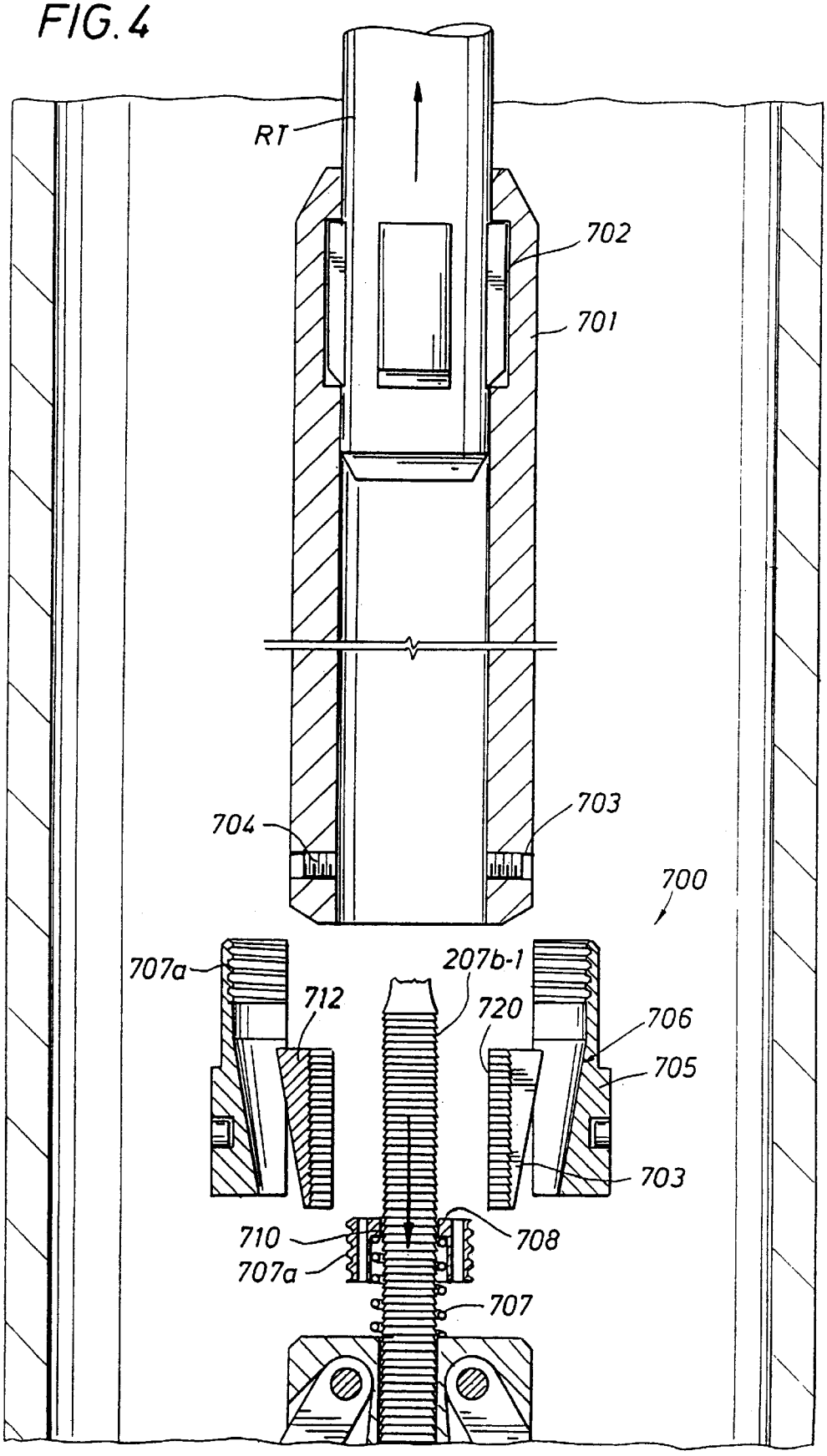
FIG. 4 is an enlarged view illustrating the separation of component parts of the set and release mechanism when it is desired to retrieve the auxiliary tool.

Within the cone housing 705 are a number of cones 712 which have an outer profile 713 which is tapered to conform with and compliment the taper of the inner surfaces of the cone housing members 705. Such cone members 712 each have a series of interiorally facing ratchet threads 711 which, when the apparatus 10 is in the set or manipulated position ratchet in one-way direction with complimentary ratchet threads 711A on the control mandrel 200, as shown in FIG. 4.

Figure 3A:
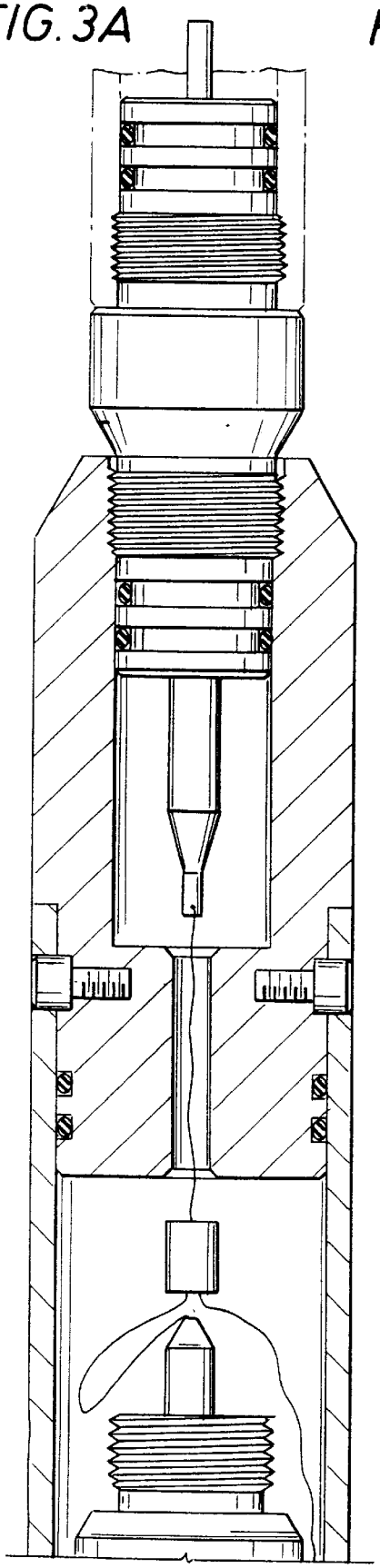
FIGS. 3A, 3B, 3C, and 3D are views similar to those, above, illustrating the position of the respective components of the apparatus of the present invention subsequent to activation of the booster pressure assembly to move the stroking rod a second or subsequent amount as a result of the combination of the booster pressure and the well fluids pressure acting upon an associated piston head assembly and engagement of the rod with the set and release mechanism.
Figure 3B:
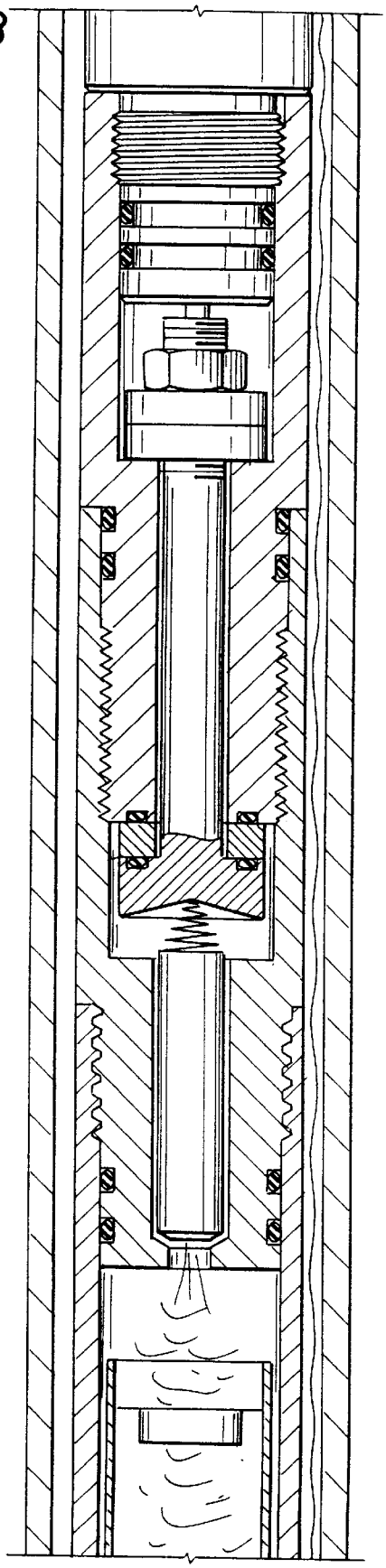
Figure 3C:
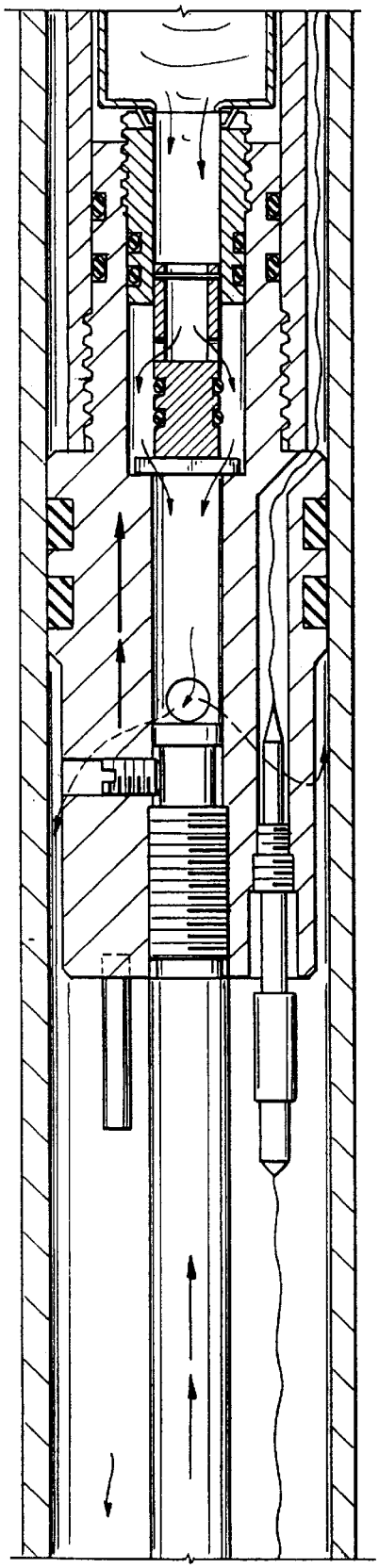
Figure 3D:
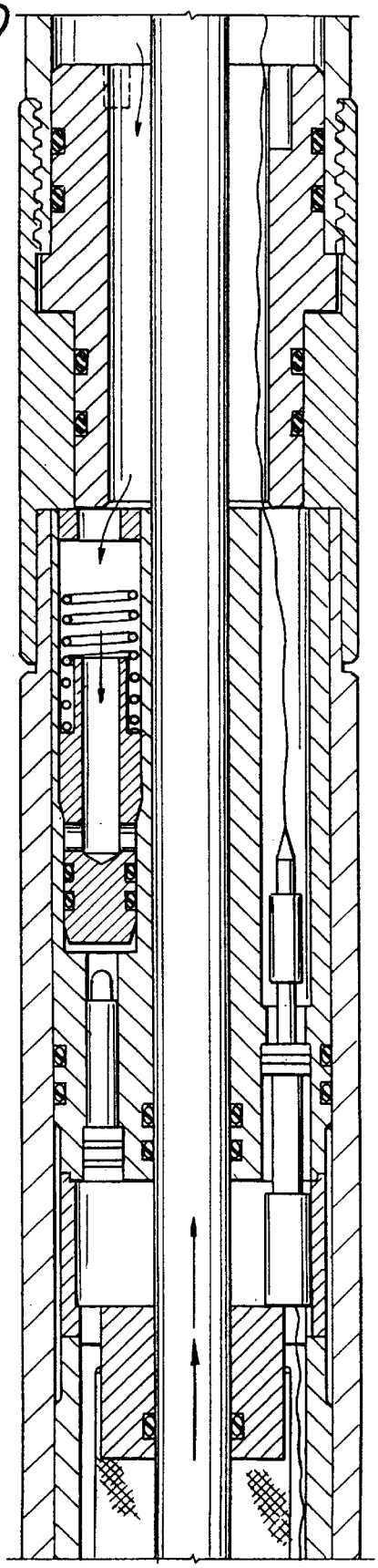
Figure 3E:
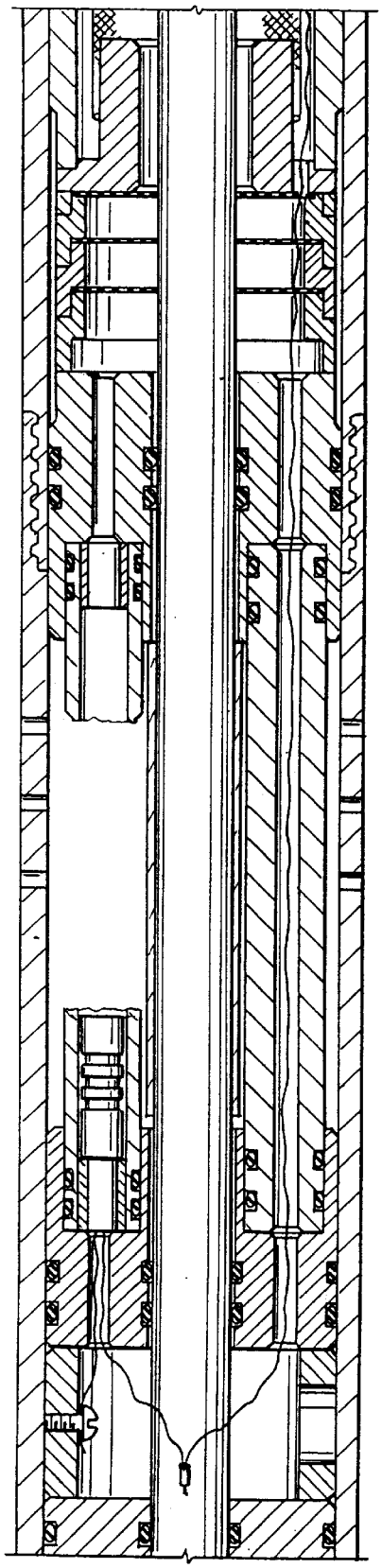
Figure 3F:
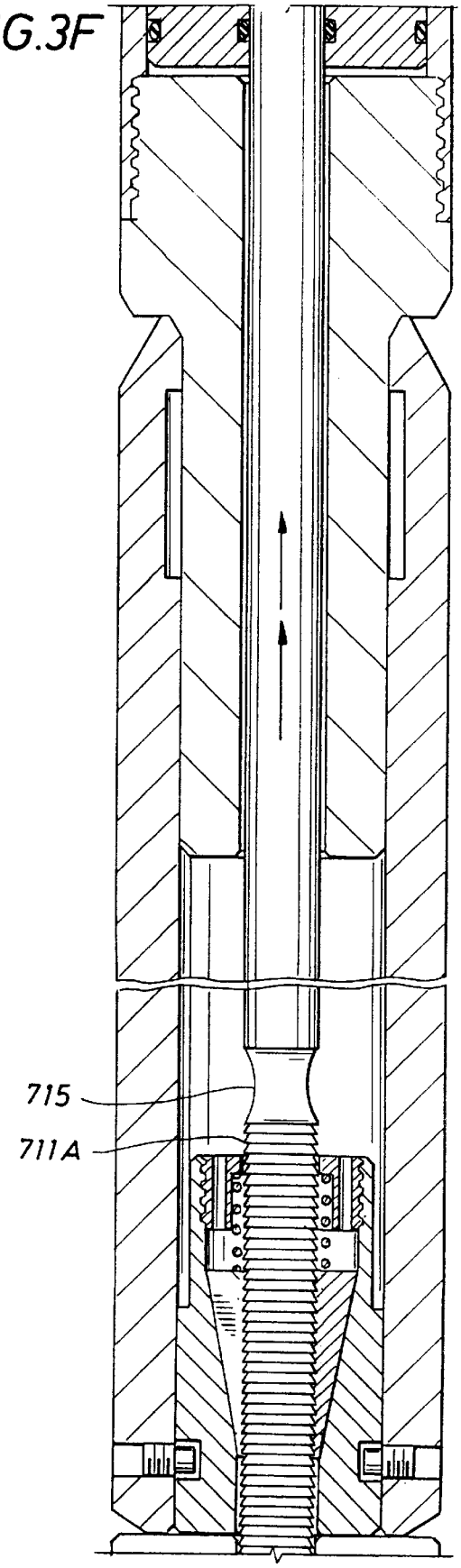

The cone members 712 as well as the cone housing members 705 are held together in relative position by means of the bias directed downwardly upon the upper ends cone members 712 by a spring 707 contained within a spring housing member 708 which, in turn, is selectively and initially secured to the cone housing members through threads 707A. The spring housing member 708 also has defined through its center an open bore 710 for receipt and movements of the control mandrel 200. Finally, as shown in FIG. 3F, the control mandrel 200 has a circumferentially extending outer cut 715 where the tensile strength of the control mandrel 200 is reduced relative to that through the mandrel 200 at other points, such that upward pull upon the mandrel 200 during the release in excess of the tensile load strength of the rod 200 at the cut 715 will cause and the mandrel 200 to part at the cut 715 and the set and release mechanism 700 will become unlocked, as described below.

Operation

When assembling the apparatus 10 at the top of the well, it will be appreciated that the pressure within the chamber 125 will be one atmosphere).

As stated earlier, the apparatus 10 may be run into the well on coiled tubing CT with the electric conduit 105 extending to the top of the well and to an operation control panel (not shown). The initial position of the device is as shown in FIGS. 1A–1F.

It will be appreciated that the auxiliary tool (not shown) may be introduced into the well prior to introduction of the apparatus 10, or, alternatively, may be carried into the well along with the apparatus 10 on the coiled tubing CT. In any event, appropriate connection of the control mandrel 200 is made either at the top of the well before run-in of the apparatus 10, or within the well in situations in which the auxiliary tool is pre-disposed therein, the connection being in normal fashion, by utilization of a number of connecting means well known to those skilled in the art, and such connection does not form any particular part of the present invention other than as described and claimed.

When it is desired to activate the apparatus 10 to manipulate the auxiliary tool, such as, for example, to set an expandable plug, or the like, an electric signal is sent through the conduit 105 through the insulated wire 109 to the diode package 220. Preferably, the diode package 220 will provide well known means to block the electric signal from the top of the well through the conduit 105 to isolate or separate such signal into positive or negative electric voltage signal. In such instance, and for purposes of illustrating the invention, it will be assumed that the diode package 220 will send only a positive electric voltage signal through line 219A to the connector 215 for activation of the booster charge assembly 208 and that the diode 220 will only send a positive electric voltage signal through the line 219B for activation of the means for selective transmission of the primary source of power 300.

Accordingly, when it is desired to manipulate the auxiliary tool with the apparatus 10, a positive polarity voltage is transmitted through the electric conduit 105 from the top of the well through the diode 220 and thence through line 219B for activation of the detonator 316 within the breachable tube 309. Upon detonation of the detonator 316, the "V"-slit 309A will cause parting at that point of the breachable tube 309 to permit opening 309A-1. At such time, well fluids defining hydrostatic pressure at the given manipulation depth in the well will pass through the first series of size fluid passages 122 through the passageways 122A, 122B and 122C, with larger particulate matter being isolated and prevented through such passageways. The well fluid enters the interior of the tube 309, into passageway 312 and through the three-step fine mesh secondary filtering provided by the screen filter assembly 400. The fluid and pressure continue upwardly through the apparatus 10 within passageway 404C and through the fine openings in the filter sock 405 into a clean fluid chamber 408. Such flow of fluid is indicated by the arrows as shown in FIGS. 2D, 2C, 2B, and 2A. The fluid now passes through the opening 503 in the meter assembly 502 for discharge through restriction 504.

As pressure builds up within the chamber 505 upwardly and downstream of the opening 504, the compressive bias afforded by spring 512 in the fluid metering and pressure locking assembly 500 will be overcome, and the check valve housing 506 will be moved downstream such that the seals 507 and 508 pass out of a seal or closed abbreviated internal diameter 509A until such seals 507 and 508 either straddle or pass below enlargement or shoulder 509 upon the interior of the check valve housing 506.

At such point, fluid may now pass through the chamber 505 and into the control chamber 511 downstream of the fluid metering and pressure locking assembly 500 by means of the passage 510 in the check valve housing 506. The fluid and hydrostatic pressure of such fluids may now act upon the lower or first piston head face 205 of the swabbing piston head 202 to urge the head 202 and the control mandrel 200 secured thereto upwardly (as indicated by the arrow on the piston head 202 in FIG. 2A) or in a down stream direction.

Urging of the piston head 202 in such direction is completed and movement of the piston head 202 relative to the cylindrical housing 100 is accomplished upon separation of the release stud 244 which secures the control mandrel 200 relative to the housing 100 against inadvertent and premature relative movement. Now, the control mandrel 200 will be stroked to a first position to manipulate the auxiliary tool a first amount.

When it is desired to activate the apparatus 10 to complete the manipulation of the auxiliary tool a second amount, the secondary source of pressure or the booster charge assembly 208, is activated. An electric voltage signal of a polarity opposite to that transmitted through the electric conduit 105 to activate the primary source of power 300 is transmitted through the insulated wire 109 to the diode package 220. In this case, since a negative signal was used to activate the primary source 300, a positive electric voltage signal will be sent through the diode package 220 through the line 219A to the connector 215. The control hammer 225 is moved by electric actuation through the connector 215 to generate a signal through the coil 221 to, in turn, actuate the explosion initiator 220 which, in turn, triggers a secondary ignitor 228 to explode the power charge 230 into the booster pressure chamber 227.

Now, the shear pin 231 holding the power charge housing 229 upon the booster piston 232 is parted and the explosive force contained within the booster pressure chamber 227 moves the booster piston 232 downwardly until the head portion 232A of the booster piston 232 comes to rest upon shoulder 202A on the swabbing piston head 202. The explosive force defined through the booster pressure chamber 227 may now pass through the piston housing 203 and into a booster cavity 241 by means of the booster power passage 238 in the booster piston 232. Since the energy resulting from the explosion of the power charge 230 within the booster pressure chamber 227 results in pressure in the booster cavity 241 and below the first piston head face 205 to be in excess of the hydrostatic well pressure which has moved the piston head 202 to the first position to manipulate the auxiliary tool a first amount, the downstream force or bias exerted through spring 512 to open the check valve housing 506 will now be overcome by the auxiliary or second booster pressure and the check valve will be shifted to its initial position to replace the seals 507 and 508 upstream of the shoulder of the 509.

Now, the hydrostatic well pressure is locked into and cannot escape from the control chamber 511 and may be used in combination with the energy provided by the auxiliary explosion in the booster pressure chamber 227 to act upon the first piston head face 205 of the swabbing piston head 202 to move it downstream, or upwardly, relative to the cylindrical housing 100 to, in turn, move the control mandrel 200 to a second position to manipulate the auxiliary tool a second amount. As the control mandrel completes its manipulation movement, the ratchet threads 716 on the control mandrel 200 will interengage those on the cones 712 and will prevent return movements of the mandrel to assure locking of activation of the auxiliary tool. The position of the component parts of the apparatus 10 now are shown in FIGS. 3A through 3F.

Release of the Apparatus from the Auxiliary Tool

When it is desired to release the apparatus 10 and retrieve same to the top of the well, or otherwise move it to another location within the well, the coiled tubing CT is pulled so that the tensile load in the cut 715 on the mandrel 200 is exceeded. The apparatus 10 may now be retrieved, leaving only the locking assembly 700 in place with the auxiliary tool. When the auxiliary tool is desired to be de-activated or retrieved, a pulling or retrieval tool (not shown) is run into the well to capture the outer housing 701 in known fashion. The outer housing 701 is urged upwardly relative to the cone housing 705 and cones 712 therein and the shear pin 704 is parted. The outer housing 701 is moved upwardly until such time as the lower end of same passes around the approximate upper end of the spring housing 708. When this occurs, slight compression between the cone housing 705 and the cone members 712 is discontinued and all such parts separate relative to one another, as shown in FIG. 4. The auxiliary tool may now be retrieved to the top of the well by use of another retrieving tool, milled out, or the like.

Another means of disengaging the apparatus 10 from the auxiliary tool is provided by means of the cut 715 in the control mandrel 200. Subsequent to manipulation of the auxiliary tool, as described, upward pull is taken at the top of the well on the control mandrel 200 until the tensile strength of the control mandrel 200 at the cut 715 is exceeded. At this time, the control mandrel 200 will part, leaving the set and release mechanism 700 and the auxiliary tool in place in manipulated position in the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for manipulating an auxiliary tool within a subterranean well comprising:

(a) means for selective transmission within said apparatus of a primary source of pressure of and defined within one of: (i) well fluids in said well and (ii) pressure generated by a controlled explosion within said apparatus;

(b) means for transmitting within said apparatus a secondary source of pressure generated by the other of: (i) well fluids in said well and (ii) pressure generated by a controlled explosion within said apparatus; and (c) means responsive to the primary source of pressure within said apparatus to manipulate the auxiliary tool a first amount and thereafter further responsive to pressure generated by the secondary source of pressure in excess of the primary source of pressure to manipulate the auxiliary tool a second amount.

2. The apparatus of claim 1 wherein the means for transmitting the primary source of pressure is actuated by electric voltage signal.

3. The apparatus of claim 1 wherein the means for generating the secondary source of pressure is actuated by electric voltage signal.

4. The apparatus of claim 1 wherein the means for transmitting the primary source of pressure is generated by one of positive and negative electric voltage signal and the means for generating the secondary source of pressure is activated by the other of positive and negative electric voltage signal.

5. The apparatus of claim 1 wherein the responsive means includes a shiftable mandrel including cooperating means for locking said mandrel in one position after the auxiliary tool has been manipulated the second amount, and further comprising cooperating locking means for said mandrel and disposed therearound, said locking means including: an outer locking housing; a series of first conically tapered outer retainers initially retained within said housing but selectively releasable therefrom; a series of second conically tapered inner retainers disposed interiorally around and within said first conically tapered outer retainers; biasing means contained within said outer retainers for urging said outer and inner retainers into a lockable position relative to said mandrel; and housing means for said biasing means initially secured around said first outer retainers and separable therefrom upon selective release of said outer locking housing relative to said outer retainers.

6. An apparatus for manipulating an auxiliary tool within a subterranean well comprising:

(a) means for selective transmission within said apparatus of a primary source of pressure of and defined within well fluids in said well;

(b) means for transmitting within said apparatus a secondary source of pressure generated by a controlled explosion within said apparatus; and (c) means responsive to the primary source of pressure within said apparatus to manipulate the auxiliary tool a first amount and thereafter further responsive to pressure generated by the secondary source of pressure in excess of the primary source of pressure to manipulate the auxiliary tool a second amount.

7. The apparatus of claim 6 wherein the means for transmitting the primary source of pressure is actuated by electric voltage signal.

8. The apparatus of claim 6 wherein the means for generating the secondary source of pressure is actuated by electric voltage signal.

9. The apparatus of claim 6 wherein the means for transmitting the primary source of pressure is generated by one of positive and negative electric voltage signal and the means for generating the secondary source of pressure is activated by the other of positive and negative electric voltage signal.

10. The apparatus of claim 1 or claim 6 wherein the responsive means includes a shiftable mandrel including cooperating means for locking said mandrel in one position after the auxiliary tool has been manipulated the second amount.

11. The apparatus of claim 1 or claim 6 wherein the responsive means includes a shiftable mandrel including cooperating means for locking said mandrel in one position after the auxiliary tool has been manipulated the second amount, and further comprising cooperating locking means for said mandrel and disposed therearound, said locking means including an outer locking housing; a series of first conically tapered outer retainers initially retained within said housing but selectively releasable therefrom; a series of second conically tapered inner retainers disposed interiorally around and within said first said conically tapered outer retainers; and biasing means contained within said outer retainers for urging said and inner retainers into a lockable position relative to said mandrel.

12. An apparatus for manipulating an auxiliary tool within a subterranean well comprising:

(a) means for selective transmission within said apparatus of a primary source of pressure of and defined within one of: (i) well fluids in said well and (ii) pressure generated by a controlled explosion within said apparatus;

(b) means for transmitting within said apparatus a secondary source of pressure generated by the other of: (i)

well fluids in said well and (ii) pressure generated by a controlled explosion within said apparatus;

(c) means responsive to the primary source of pressure within said apparatus to manipulate the auxiliary tool a first amount and thereafter further responsive to pressure generated by the secondary source of pressure in excess of the primary source of pressure to manipulate the auxiliary tool a second amount; and (d) means for selectively capturing the pressure of the well fluids within said apparatus during manipulation of the auxiliary tool the second amount.

13. A method for manipulating an auxiliary tool within a subterranean well comprising the steps of:

(a) running into said well upon a conduit in combination with said auxiliary tool to a pre-selected position for manipulating said auxiliary tool, a manipulating tool comprising:

(1) means for selective transmission within said apparatus of a primary source of pressure of and defined within well fluids in said well;

(2) means for transmitting within said apparatus a secondary source of pressure generated by a controlled explosion within said apparatus; and (3) means responsive to the primary source of pressure within said apparatus to manipulate the auxiliary tool of first amount and thereafter further responsive to pressure generated by the secondary source of pressure in excess of the pressure within said apparatus of and defined within the well fluids to manipulate the auxiliary tool a second amount;

(b) actuating the means for selective transmission of the primary source of pressure defined within the well fluids by transmitting to said selective transmission means an electronic voltage signal whereby said well fluids are communicated within said apparatus to act upon the means responsive to the primary source of pressure to manipulate the auxiliary tool a first amount; and (c) initiating a controlled explosion within said apparatus by transmitting through said apparatus a second electric voltage signal whereby the secondary source of pressure generated by the explosion is transmitted within said apparatus and upon the means responsive to the primary source of pressure to manipulate the auxiliary tool a second amount.

14. An apparatus for manipulating an auxiliary tool within a subterranean well by the initial application of hydrostatic well pressure and thereafter concurrently with pressure generated by an electrically actuated force within the apparatus, comprising:

(a) a cylindrical housing;

(b) a control mandrel extending within said housing and including a piston head with first and second piston head faces thereon;

(c) an atmospheric chamber within said housing, one end of said chamber terminating at one of the first and second piston head faces;

(d) valving means responsive to electric voltage to selectively communicate hydrostatic well pressure within said well and exterior of said apparatus across the other of the first and second piston head faces and move said mandrel in one direction from an initial position to a first position for manipulation of said tool;

(e) explosion means actuatable by electric voltage to generate booster pressure within said apparatus for concurrent application with said hydrostatic well pressure across the said other of the first and second piston head faces after said mandrel has been moved to said first manipulation position to drive said mandrel further in said direction to a completed manipulation position; and (f) means for capturing the hydrostatic well pressure within said housing and across the said other of the first and second faces of said piston head during movement of said mandrel between the first and completed manipulation positions.

15. The apparatus of claim 14 wherein said valving means is responsive to one of positive and negative electric voltage to communicate the hydrostatic well pressure across the said other of the first and second faces of said piston head.

16. The apparatus of claim 14 wherein said valving means is responsive to one of positive and negative electric voltage to communicate the hydrostatic well pressure across the said other of the first and second faces of said piston head, and the explosion means is activatable by the other of positive and negative voltage.

17. The apparatus of claim 14 further including means for receiving a source of electric current and for separating said current into positive and negative voltage for actuation of said valving means and said explosion means.

18. The apparatus of claim 14 wherein said valving means comprises:

(a) a breachable tubular housing; and (b) detonator means disposed within said breachable tubular housing and activatable by electric voltage to thereby detonate and breach said tubular housing whereby thereafter communication of the hydrostatic well pressure is established to the second face of said piston head.

19. The apparatus of claim 14 further comprising well fluid filtering means including: a first series of sized fluid passages defined through the cylindrical housing.

20. The apparatus of claim 14 further comprising well fluid filtering means including: screen means disposed downstream of said valving means and within said cylindrical housing for separating sized particulate matter within said well fluid.

21. The apparatus of claim 14 further comprising well fluid filtering means including: a fabric filter sock disposed around said mandrel and downstream of said screen means to further separate particular matter passing through said screen means within said well fluids.

22. The apparatus of claim 14 further comprising well fluid filtering means including:

(a) a first series of sized fluid passages defined through the cylindrical housing;

(b) screen means disposed downstream of said valving means and within said cylindrical housing for separating sized particulate matter within said well fluid; and (c) a fabric filter sock disposed around said mandrel and downstream of said screen means to further separate particular matter passing through said screen means within said well fluids.

23. The apparatus of claim 14 further comprising a filtering system for said well fluids within said cylindrical housing, comprising:

(a) a tubular filter housing sealingly secured at each end relative to said mandrel, said tubular filter housing having an open end downstream of said valving means;

(b) filter screen means disposed within and across said open end of said tubular filter housing;

(c) a fabric filter sock extending around the exterior of said tubular filter housing and downstream of said screen means; and (d) well fluid passage means within the interior of said tubular filter housing extending from across said screen means within the interior of said tubular filter housing and through the fabric filter sock.

24. The apparatus of claim 14 further comprising metering means for controlling the rate of flow of the well fluids within said cylindrical housing subsequent to response of said valving means to electric voltage.

25. The apparatus of claim 14 wherein the means for capturing the hydrostatic well pressure within said housing and across the second face of said piston head comprises a one-way check valve assembly.

26. A method for manipulating an auxiliary tool within a subterranean well comprising the steps of:

(a) running into said well upon a conduit in combination with said auxiliary tool a manipulating tool to a pre-selected position for manipulating said auxiliary tool comprising:

1. a cylindrical housing;
2. a control mandrel extending within said housing and including a piston head with first and second piston head faces thereon;
3. an atmospheric chamber within said housing, one end of said chamber terminating at one of the first and second piston head faces;
4. valving means responsive to electric voltage to selectively communicate hydrostatic well pressure within said well and exterior of said apparatus across the other of the first and second piston head faces and move said mandrel in one direction from an initial position to a first position for manipulation of said tool;
5. explosion means actuatable by electric voltage to generate booster pressure within said apparatus for concurrent application with said hydrostatic well pressure across the other of the first and second piston head faces after said mandrel has been moved to said first manipulation position to drive said mandrel further in said direction to a completed manipulation position; and
6. means for capturing the hydrostatic well pressure within said housing and across said other of the first and second piston head faces during movement of said mandrel between the first and completed manipulation positions;

(b) transmitting an electric voltage signal to said valve means to open said valve means to communicate the hydrostatic well pressure across the second face of said piston head whereby the mandrel moves in one direction from the initial position to the first position for manipulation of the auxiliary tool; and thereafter (c) transmitting a second electric voltage signal to activate the explosion means to generate booster pressure within the apparatus whereby the well pressure and the booster pressure are concurrently applied across the said other of the first and second piston head faces of the second piston head to drive the mandrel further in the said direction to the completed manipulation position.

27. A method for manipulating an auxiliary tool within a subterranean well comprising the steps of:

(a) running into said well upon a conduit in combination with said auxiliary tool a manipulating tool to a pre-selected position for manipulating said auxiliary tool comprising:

(1) a cylindrical housing;

(2) a control mandrel extending within said housing and including a piston head with first and second piston head faces thereon;

(3) an atmospheric chamber within said housing, one end of said chamber terminating at the first piston head face;

(4) valving means responsive to one of positive and negative electric voltage signal to selectively communicate hydrostatic well pressure within said well and exterior of said apparatus across the second piston head face and move said mandrel in one direction from an initial position to a first position for manipulation of said tool;

(5) explosion means actuatable by the other of positive and negative electric voltage and to generate booster pressure within said apparatus for concurrent application with said hydrostatic well pressure across said second piston head face after said mandrel has been moved to said first manipulation position to drive said mandrel further in said direction to a completed manipulation position; and (6) means for capturing the hydrostatic well pressure within said housing and across the second face of said piston head during movement of said mandrel between the first and completed manipulation positions;

(b) transmitting one of positive or negative electric voltage signal to said valving means to communicate the hydrostatic well pressure across the second face of said piston head whereby the mandrel moves in one direction from the initial position to the first position for manipulation of the auxiliary tool; and thereafter (c) transmitting to the explosion means the other of positive and negative electric voltage signal to actuate said explosion means to generate booster pressure within the apparatus whereby the well pressure and the booster pressure are concurrently applied across the face of the second piston head to drive the mandrel further in the said direction to a completed manipulation position.

28. A method for manipulating an auxiliary tool within a subterranean well comprising the steps of:

(a) running into said well upon a conduit a manipulating tool to a pre-selected position for manipulating said auxiliary tool comprising:

(1) a cylindrical housing;

(2) a control mandrel extending within said housing and including a piston head with first and second piston head faces thereon;

(3) an atmospheric chamber within said housing, one end of said chamber terminating at the first piston head face;

(4) valving means responsive to one of positive and negative electric voltage signal to selectively communicate hydrostatic well pressure within said well and exterior of said apparatus across the second piston head face and move said mandrel in one direction from an initial position to a first position for manipulation of said tool;

(5) explosion means actuatable by the other of positive and negative electric voltage and to generate booster pressure within said apparatus for concurrent application with said hydrostatic well pressure across said second piston head face after said mandrel has been moved to said first manipulation position to drive said mandrel further in said direction to a completed manipulation position;

(6) means for capturing the hydrostatic well pressure within said housing and across the second face of said piston head during movement of said mandrel between the first and completed manipulation positions; and (7) cooperating means on said mandrel for locking said mandrel in the completed manipulation position;

(b) transmitting one of positive or negative electric voltage signal to said valving means to communicate the hydrostatic well pressure across the second face of said piston head whereby the mandrel moves in one direction from the initial position to the first position for manipulation of the auxiliary tool; and thereafter (c) transmitting to the explosion means the other of positive and negative electric voltage signal to actuate said explosion means to generate booster pressure within the apparatus whereby the well pressure and the booster pressure are concurrently applied across the face of the second piston head to drive the mandrel further in the said direction to a completed manipulation position to activate the cooperating means for locking the mandrel in the completed manipulation position whereby further movement of said mandrel in one direction is prevented.

29. The method of claim 28 wherein the apparatus further includes cooperating locking means for the mandrel and disposed around said mandrel, said locking means including an outer locking housing; a series of first conically tapered outer retainers initially retained within said housing but selectively releasable therefrom; a series of second conically tapered inner retainers disposed interiorally therearound and within said first conically tapered outer retainers; and biasing means contained within said outer retainers for urging said outer and inner retainers into a lockable position relative to said mandrel, and further including a step of: (d) shifting said outer locking housing relative to the outer retainers to release said outer retainers and said inner retainers from the lockable position relative to said mandrel.

30. An apparatus for manipulating an auxiliary tool within a subterranean well by the initial application of hydrostatic well pressure and thereafter concurrently with pressure generated by an electrically actuated force within the apparatus, comprising:

(a) a cylindrical housing;

(b) a control mandrel extending within said housing and including a piston head with first and second piston head faces thereon, said control mandrel including means thereon defining a reduced tensile load through said mandrel whereby upon application of tensile load upon said mandrel in one direction in excess of the tensile load defined at said point, said mandrel will separate for subsequent retrieval with said apparatus from the well;

(c) an atmospheric chamber within said housing, one end of said chamber terminating at one of the first and second piston head faces;

(d) valving means responsive to electric voltage to selectively communicate hydrostatic well pressure within said well and exterior of said apparatus across the other of the first and second piston head faces and move said mandrel in one direction from an initial position to a first position for manipulation of said tool;

(e) explosion means actuatable by electric voltage to generate booster pressure within said apparatus for concurrent application with said hydrostatic well pressure across the said other of the first and second piston head faces after said mandrel has been moved to said first manipulation position to drive said mandrel further in said direction to a completed manipulation position; and (f) means for capturing the hydrostatic well pressure within said housing and across the said other of the first and second faces of said piston head during movement of said mandrel between the first and completed manipulation positions.

* * * * *